US007278782B2

(12) United States Patent
Ebi

(10) Patent No.: US 7,278,782 B2
(45) Date of Patent: Oct. 9, 2007

(54) ANALOG ELECTRONIC CLOCK HAVING RESET CURRENT CONDUCTIVE STRUCTURE

(75) Inventor: Akira Ebi, Chiba (JP)

(73) Assignee: Seiko Instruments Inc. (JP)

( * ) Notice: Subject to any disclaimer, the term of this patent is extended or adjusted under 35 U.S.C. 154(b) by 69 days.

(21) Appl. No.: 11/341,744

(22) Filed: Jan. 27, 2006

(65) Prior Publication Data

US 2006/0176778 A1 Aug. 10, 2006

(30) Foreign Application Priority Data

Feb. 4, 2005 (JP) ..... 2005-029316

(51) Int. Cl.
*G04B 27/02* (2006.01)

(52) U.S. Cl. ..... 368/190; 368/191; 368/321

(58) Field of Classification Search ..... 368/190–199, 368/321

See application file for complete search history.

(56) References Cited

U.S. PATENT DOCUMENTS 4,720,823 A * 1/1988 Terzian ..... 368/190
4,794,576 A * 12/1988 Schwartz et al. ..... 368/185
5,339,297 A * 8/1994 Suzuki et al. ..... 368/321
5,452,270 A * 9/1995 Ikeda et al. ..... 368/273
5,644,553 A * 7/1997 Cuinet ..... 368/320
6,466,518 B1 * 10/2002 Akahane et al. ..... 368/64
6,779,916 B2 * 8/2004 Watanabe ..... 368/190
6,846,998 B2 * 1/2005 Hasumi et al. ..... 200/341
6,896,403 B1 * 5/2005 Grau ..... 368/190
6,994,466 B2 * 2/2006 Kojima ..... 368/191
2003/0161219 A1 * 8/2003 Kojima ..... 368/190
2006/0140061 A1 * 6/2006 Haga ..... 368/88
2006/0140064 A1 * 6/2006 Haga ..... 368/190

* cited by examiner

*Primary Examiner*—Gary F. Paumen
(74) *Attorney, Agent, or Firm*—Adams & Wilks

(57) ABSTRACT

To provide a reset current conductive path between a reset lever and an overhang of a printed circuit board without using a conductive part such as a metal pin and without bending a distal end portion of the reset lever. When a movement is assembled, an overhang pattern is accommodated in an embracing recessed portion which is formed in a plate, is bent to a height of a reset lever, and a distal end portion of the overhang pattern reaches a recessed portion which is dug downwardly from a reset lever planar moving surface. Then, such a bent state of the overhang pattern is held by arm portions of the embracing recessed portion. Accordingly, when a winding stem is pulled by one stage, the reset lever performs the planar movement in the given direction and a distal end portion of the reset lever is brought into contact with the overhang pattern. Accordingly, it is possible to form a reset current conductive path which transmits a potential applied to the reset lever when the gear train is stopped to an IC which is mounted on the printed circuit board.

6 Claims, 6 Drawing Sheets

ANALOG ELECTRONIC CLOCK HAVING RESET CURRENT CONDUCTIVE STRUCTURE

BACKGROUND OF THE INVENTION

1. Field of the Invention

The present invention relates to an analog electronic clock having a reset current conductive structure which is constituted of a winding stem and a reset lever.

2. Description of the Prior Art

In an analog electronic clock including a stepping motor and a pointer-type display apparatus, the rotation of a stepping motor is transmitted to the pointer-type display apparatus from a rotor gear which is integrally provided to a rotor by way of a gear train. The stepping motor is constituted of a stator provided with a stator coil and the rotor provided with a rotor magnet. A driving current whose flow direction is inverted for every 1 second is applied to the stator coil from a motor drive circuit and hence, the stepping motor is regularly and accurately rotated.

As has been well-known, in the analog electronic clock which includes the stepping motor and the pointer-type display apparatus, a user who corrects a clock pulls the winding stem by one stage and manipulates the winding stem so as to rotate an hour hand and a minute hand to perform the clock adjustment. When the clock adjustment is completed, the user pushes the winding arm to a base. At the time of performing the clock adjustment, that is, during a period from a point of time that the user pulls the winding stem by one stage to a point of time that the user pushes the winding stem to the base, a second hand is stopped in a forcible manner.

The forcible stopping of the second hand at the time of performing the clock adjustment is realized by a mechanism which brings a reset lever into contact with a particular part which constitutes the gear train which transmits a rotational force of the rotor of the step motor to the second hand and generates a frictional force which stops the second hand. The above-mentioned reset lever is a part which is interlocked with the operation of the winding stem, and is arranged such that the reset lever is brought into contact with a particular part which constitutes the gear train when the winding stem is pulled by one stage and is separated from the above-mentioned particular part when the winding stem is again pushed to an original position.

Here, even in a state that the second hand is stopped in a forcible manner by the reset lever at the time of performing the clock adjustment, the current whose flow direction is inverted for every 1 second is applied to the stator coil of the stepping motor and hence, a magnetic field generated in the stator coil is inverted for every 1 second, whereby a state which allows the rotation of the rotor magnet and a state which stops the rotor magnet take place alternately for every second.

Thereafter, when the clock adjustment is finished and the clock is returned to a usual hand moving state, the winding stem is pushed to the base so as to remove the reset lever which is interlocked with the winding stem from the gear train and hence, the rotor of the stepping motor is rotated and the gear train is rotated due to a driving force of the rotational motion thus operating pointers.

Here, with respect to the structure which does not take the delay of starting of moving hands into consideration, the currents whose flow directions are inverted for every 1 second are continuously applied alternately and hence, there arises a phenomenon that the second hand is stopped for 2 seconds at maximum when the gear train stop is released. That is, when the relationship between a magnetic field which the stator coil generates and a magnetic field of the rotor magnet releases the gear train stop immediately after a state which allows the rotation of the rotor, the rotor is not rotated. This is because that immediately after the state that the relationship between the magnetic field which the stator coil generates and the magnetic field of the rotor magnet rotates the rotor, the relationship between these magnetic fields is in a state which allows the stopping of the rotor. The relationship between these magnetic fields is inverted after 1 second. Accordingly, when the gear train is released, the second hand does not start moving immediately but starts moving after stopping for 2 seconds at maximum.

To change the state from the time correction state to the usual hand moving state in this manner, the second hand is stopped for 2 seconds at maximum depending on the timing. Accordingly, to avoid such a phenomenon, when the gear train is stopped, it is necessary to recognize the direction of the current applied to the coil initially using an IC, and when the gear train is mechanically operated, it is necessary to determine the direction of the current which is outputted to the coil firstly. Accordingly, a reset current conductive structure for transmitting the potential applied to the reset lever when the gear train is stopped to the IC is additionally provided.

As the conventional reset current conductive structure which selectively performs the electrical connection between the circuit pattern of the IC-mounted printed circuit board and the reset lever, there have been known following structures.

That is, the conventional reset current conductive structure in the thin printed circuit board made of polyimide is, for example, as shown in FIG. 1 which is a plan view and FIG. 6 which is a cross-sectional view of an essential part, constituted of a winding stem 8, a reset lever 3 having no bent portion on a distal end portion thereof, a metal pin 9 which is a conductive part, and an overhang-pattern 4*a* of the printed circuit board 4. The reset lever 3 is arranged on a plate 1 in a state that the reset lever 3 is movable on the plane. The metal pin 9 has one end thereof press-fit in a hole formed in the plate 1 and brings the other end thereof into contact with a lower surface of the overhang pattern 4*a* of the printed circuit board 4. The overhang pattern 4*a* extends substantially horizontally from an end portion of the printed circuit board 4. Further, the overhang pattern 4*a* of the printed circuit board 4 is supported on a resilient support portion of a gear train base 2. The resilient support portion of the gear train base 2 is constituted of a cantilever portion which is formed on the gear train base 2 and a pressing spring 10 which is mounted on the gear train base 2. In short, the metal pin 9 is positioned and fixed by a housing such as the plate 1 and the gear train base 2 such that the metal pin 9 reaches a height of the reset lever 3. Due to such a constitution, when the winding stem 8 is pulled by one stage, the reset lever 3 is moved on the plane in the given direction and the distal end portion of the reset lever 3 is brought into contact with a peripheral surface of the metal pin 9. Accordingly, it is possible to form a reset current conductive path which transmits a potential applied to the reset lever 3 when the gear train is stopped to an IC mounted on the printed circuit board 4.

Next, the conventional reset current conductive structure in the thick printed circuit board made of glass epoxy or the like uses a reset lever having a bent portion, wherein the above-mentioned bent portion and a circuit pattern of the above-mentioned printed circuit board are selectively brought into contact with each other by manipulating the above-mentioned reset lever.

The conventional reset current conductive structure in the thick printed circuit board made of glass epoxy or the like is constituted of a reset lever having no bent portion and a conductive metal pin which is provided to the IC-mounted printed circuit board and is electrically connected with the circuit patter thereof, wherein the above-mentioned reset lever is manipulated so as to perform a selective contact with the above-mentioned conductive part.

Still another conventional reset current conductive structure in the thick printed circuit board made of glass epoxy or the like is constituted of a reset lever having no bent portion and a conductive part such as a metal pin which is positioned and fixed by a housing such that the conductive part reaches a height of the above-mentioned reset lever, wherein the above-mentioned conductive part is brought into contact with a circuit pattern of the IC-mounted printed circuit board and the above-mentioned reset lever is manipulated so as to perform a selective contact with the above-mentioned conductive part.

However, the analog electronic clock provided with the conventional reset current conductive structure has a following drawback. That is, the analog electronic clock which uses the conductive part such as the metal pin pushes up a cost by an amount corresponding to the number of parts. With respect to the analog electronic clock which does not use the conductive part such as the metal pin and uses the reset lever provided with the bent portion, there arises a drawback that the machining of the above-mentioned reset lever is difficult. That is, the bent portion of the above-mentioned reset lever is brought into contact with the circuit pattern and hence, the fluctuation of a bending quantity is large and the bent portion is a movable part thus giving rise to a drawback that it is difficult to maintain a stable contact pressure due to irregularities of machining accuracy attributed to yielding or bending of the spring.

Accordingly, the applicant of the present invention has, as disclosed in JP-UM-A-5-71791, developed the reset current conductive structure which does not use a conductive part and, at the same time, uses a reset lever having no bent portion at a distal end portion thereof before assembling. That is, the reset lever 3 which is engaged with the winding stem is configured such that the distal end portion thereof is a part which does not have the bent portion as a single member and the distal end portion is deflected due to a projecting portion formed on a plate 1 when the distal end portion is assembled into a module and generates the resiliency. Due to such a structure, when the winding stem is pulled by one stage, the reset lever is moved on the plane and the distal end is brought into contact with a circuit pattern. In this case, a contact pressure of the distal end of the reset lever to the circuit pattern of the printed circuit board becomes stable.

However, also in the reset current conductive structure disclosed in JP-UM-A-5-71791, the reset lever 3 functions substantially in the same manner as the part which has the bent portion on the distal end portion thereof after the reset lever 3 is assembled into a movement and hence, in a long-term basis, there arises a drawback that the reset lever 3 is a movable portion and hence, the spring is yielded. Further, the distal end portion of the reset lever is deflected at the time of assembling due to the projecting portion formed on the plate and hence, there also arises a drawback that the irregularities are generated with respect to a resilient force of the above-mentioned distal end portion.

The task to be solved by the present invention lies in that, in the reset current conductive structure which is constituted of a winding stem, a reset lever and an overhang pattern of a printed circuit board, a reset current conductive path is formed between the reset lever and an overhang of the printed circuit board without using a conductive part such as a metal pin and without bending a distal end portion of the reset lever.

SUMMARY OF THE INVENTION

To achieve the above-mentioned task, the present invention provides an analog electronic clock having a reset current conductive structure which is constituted of a winding stem, a reset lever having no bent portion on a distal end portion thereof, and an overhang-pattern of a printed circuit board, wherein the overhang-pattern is bent to a height of the reset lever and, at the same time, a bent state of the overhang-pattern is held by a holding means which is mounted in a housing such as a plate, a gear train base or the like.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

The reset current conductive structure according to the present invention is characterized in that, in an analog electronic clock having the reset current conductive structure which is constituted of a winding stem, a reset lever having no bent portion on a distal end portion thereof and an overhang pattern of a printed circuit board, the above-mentioned overhang pattern is bent to a height of the above-mentioned reset lever, that is, a reset lever planar moving surface of a plate 1 and, at the same time, a bent state of the overhang pattern is held by a holding means mounted on a housing.

Further, the above-mentioned holding means is an embracing recessed portion which is formed on a vertical surface of the plate which joins the reset lever planar moving surface of the plate and a printed circuit board mounting surface. Due to the provision of the embracing recessed portion, the overhang pattern is held in a state that the overhang pattern is bent to a height of the above-mentioned reset lever.

Accordingly, when the winding stem is pulled by one stage, the reset lever performs the planar movement on the surface of the plate in a given direction and brings the distal end portion thereof into contact with the bent portion of the above-mentioned overhang pattern. Accordingly, a reset current conductive path which transmits a potential applied to the reset lever when a gear train is stopped to an IC mounted on the printed circuit board is formed.

Figure 1:
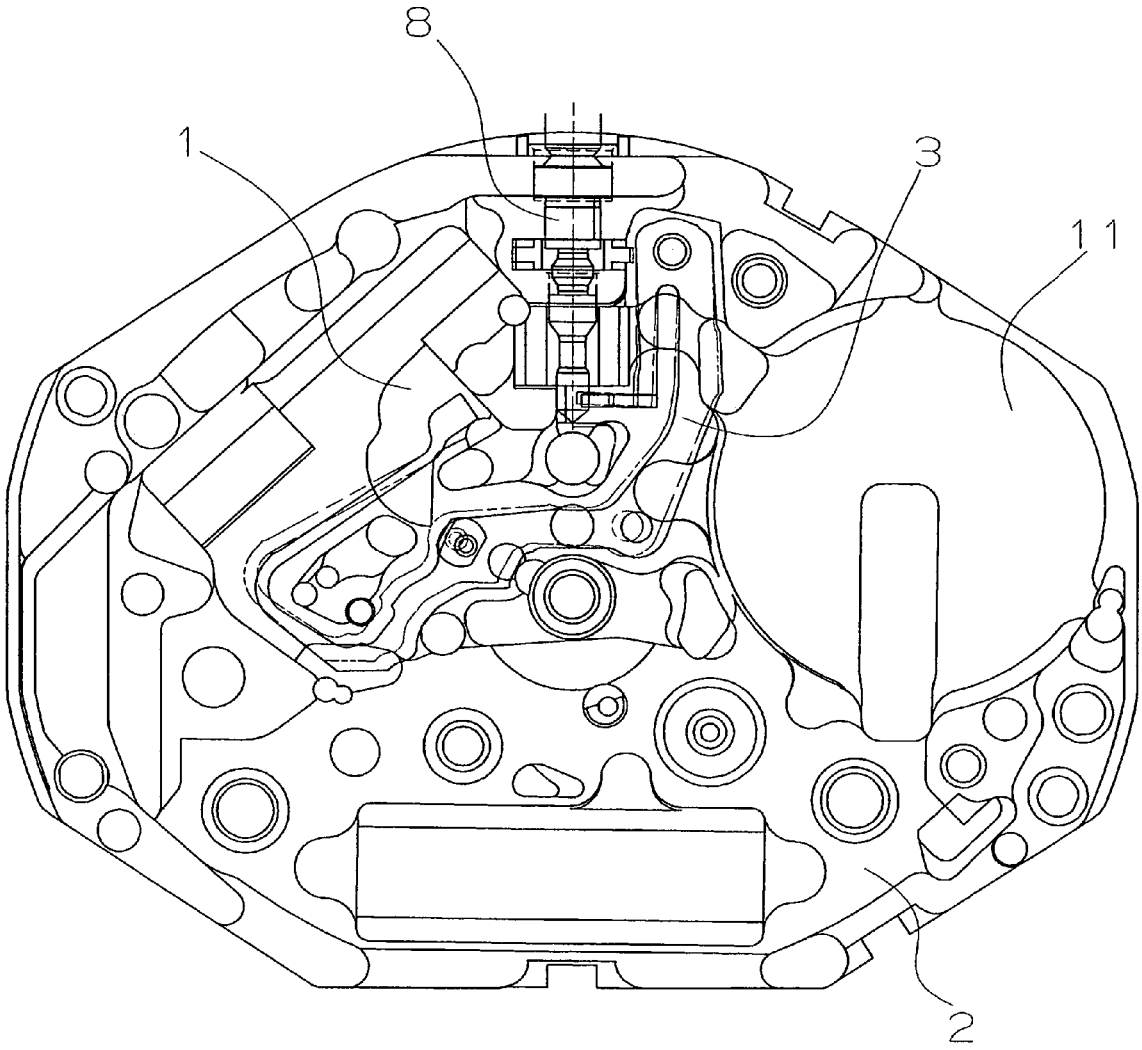
FIG. 1 is a plan view of an analogue electronic clock having the reset current conductive structure.
Figure 2:
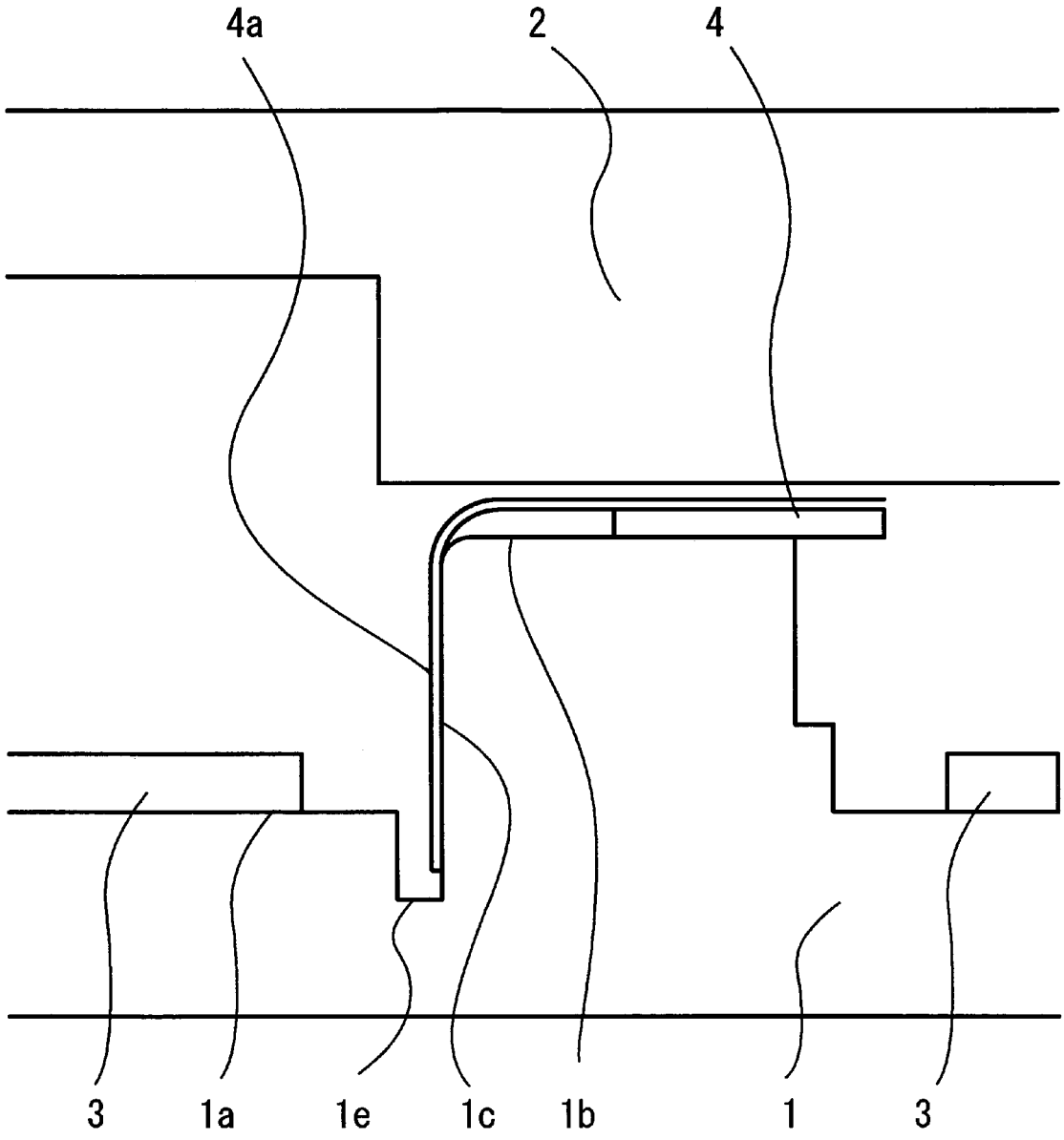
FIG. 2 is an enlarged cross-sectional view of an essential part of the reset current conductive structure adopted by an analogue electronic clock of an embodiment 1 of the present invention.

As shown in FIG. 1 which is a plan view, FIG. 2 which is a cross-sectional view of an essential part and FIG. 3 which is a partial side view and a partial plan view of the essential part, an analog electronic clock of the embodiment 1 of the present invention is characterized in that, in the analog electronic clock having the reset current conductive structure which is constituted of a winding stem 8, a reset lever 3 having no bent portion on a distal end portion thereof, and an overhang pattern 4*a* of a thin printed circuit board 4 made of polyimide or the like, the above-mentioned overhang pattern 4*a* is bent to a height of the reset lever 3, that is, a reset lever planar moving surface 1*a* of a plate 1 and, at the same time, a bent state of the overhang pattern 4*a* is held by a holding means shown in FIG. 3.

Figure 3A:
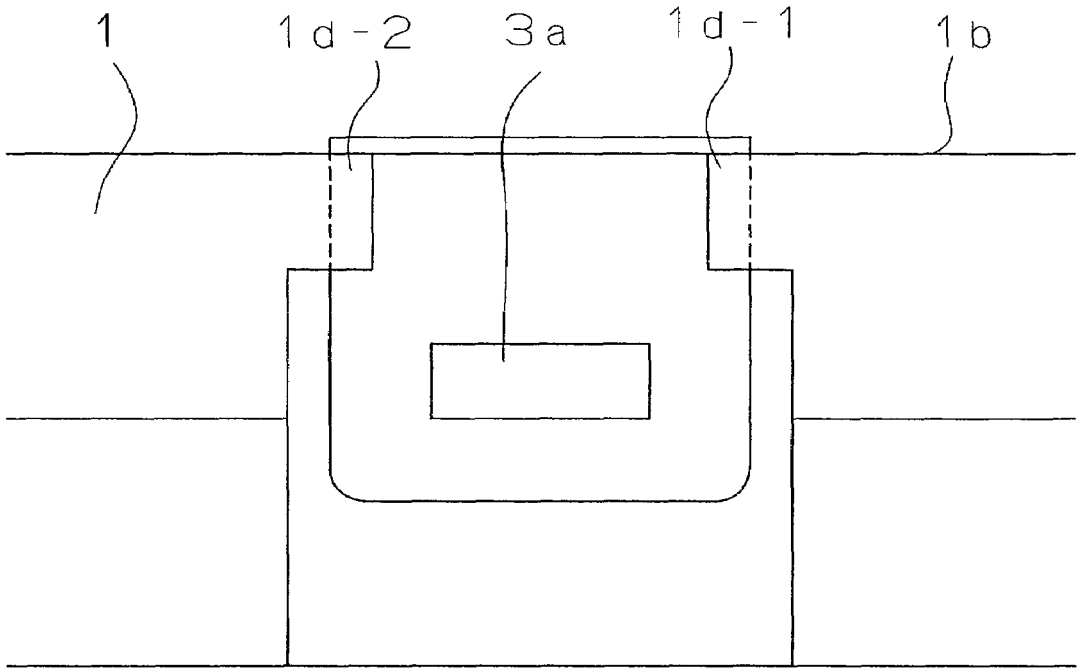
FIG. 3A is an enlarged partial side view of an essential part of the reset current conductive structure of FIG. 2 as viewed from a left side and FIG. 3B is an enlarged partial plan view of FIG. 3A as viewed from above.
Figure 3B:
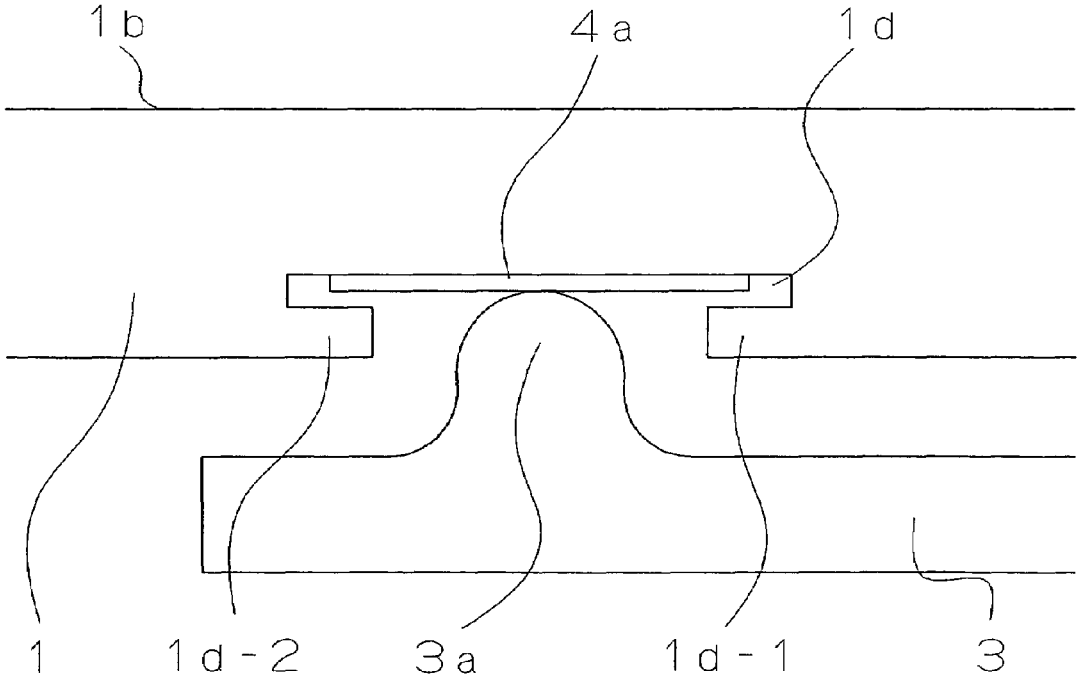

That is, the holding means adopted by the embodiment 1 is, as shown in FIG. 3, constituted of an embracing recessed portion 1*d* which is formed in a vertical surface 1*c* of the plate 1 which joins the reset lever planar moving surface 1*a* of the plate 1 and a printed circuit board mounting surface 1*b*. The embracing recessed portion 1*d* includes, as shown in FIG. 3A which is the partial side view as viewed from a left side of FIG. 2 and FIG. 3B which is the partial plan view as viewed from above in FIG. 3A, arm portions 1*d*-1, 1*d*-2 which project on both sides of an opening portion for reset lever.

When the movement is assembled, the overhang pattern 4*a* is accommodated in the embracing recessed portion 1*d* which is formed in the plate 1, is bent to the height of reset lever 3, and a distal end portion of the overhang pattern 4*a* reaches a recessed portion 1*e* which is dug downwardly from the reset lever planar moving surface 1*a*. Then, such a bent state of the overhang pattern 4*a* is held by the arm portions 1*d*1, 1*d*-2 of the embracing recessed portion 1*d*. Accordingly, when the winding stem 8 is pulled by one stage, the reset lever 3 performs the planar movement on the surface of the plate 1 in the given direction and the distal end portion 3*a* is brought into contact with the overhang pattern 4*a*. Accordingly, it is possible to form a reset current conductive path which transmits a potential applied to the reset lever 3 when the gear train is stopped to an IC which is mounted on the printed circuit board 4.

Figure 4:
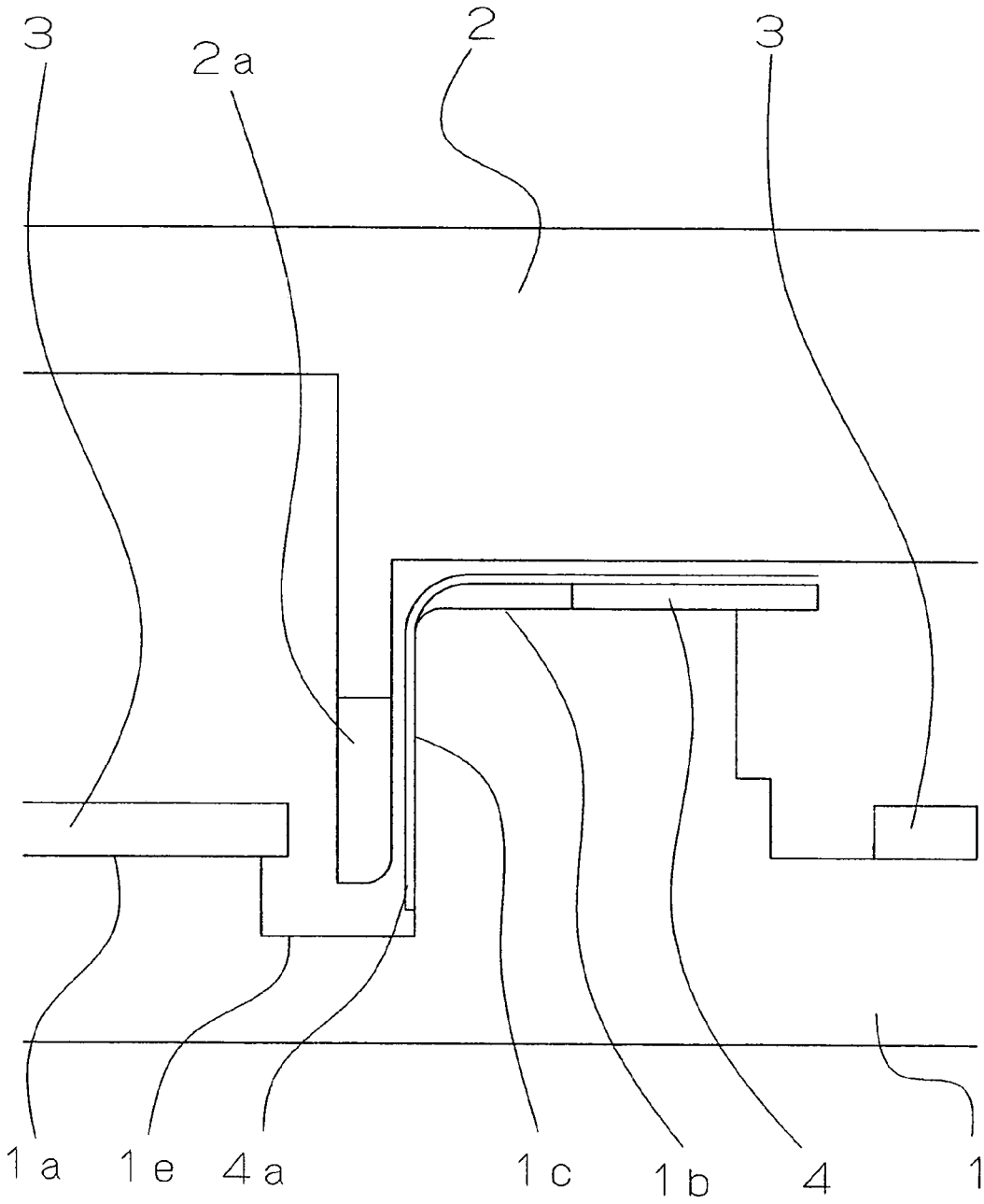
FIG. 4 is an enlarged cross-sectional view of an essential part of the reset current conductive structure adopted by an analogue electronic clock of an embodiment 2 of the present invention.

An analog electronic clock of the embodiment 2 of the present invention is, as shown in FIG. 1 which is the plan view and FIG. 4 which is a cross-sectional view of an essential part, characterized in that in the analog electronic clock having the reset current conductive structure which is constituted of a winding stem 8, a reset lever 3 having no bent portion on a distal end portion thereof and an overhang pattern 4*a* of a thin printed circuit board 4 made of polyimide or the like, the above-mentioned overhang pattern 4*a* is bent to a height of the reset lever 3, that is, a reset lever planar moving surface 1*a* of a plate 1 and, at the same time, a bent state of the overhang pattern 4*a* is held by a holding means shown in FIG. 4.

That is, the holding means adopted by the embodiment 2 is, as shown in FIG. 4, constituted of a pressing arm 2*a* which presses the overhang pattern 4*a* to a vertical surface 1*c* of a plate 1 which joins the reset lever planar moving surface 1*a* and a printed circuit board mounting surface 1*b*. The pressing arm 2*a* is constituted of two arms which are integrally formed on a gear train base 2 and presses the overhang pattern 4*a* on both sides of a region with which the reset lever 3 is brought into contact to the vertical surface 1*c* of the plate 1.

When the movement is assembled, the overhang pattern 4*a* is bent to the height of the reset lever 3 due to the pressing arm 2*a* which is integrally formed on the gear train base 2, and a distal end portion of the overhang pattern 4*a* reaches a recessed portion 1*e* which is dug downwardly from the reset lever planar moving surface 1*a*. Then, such a bent state of the overhang pattern 4*a* is held by the pressing arm 2*a*. The overhang pattern is held in a state that the overhang pattern is bent to the height of the reset lever. Accordingly, when the winding stem 8 is pulled by one stage, the reset lever 3 performs the planar movement on a surface of the plate 1 in the given direction and the distal end portion 3*a* is brought into contact with the overhang pattern 4*a*.Accordingly, it is possible to form a reset current conductive path which transmits a potential applied to the reset lever 3 when the gear train is stopped to an IC which is mounted on the printed circuit board 4.

Figure 5:
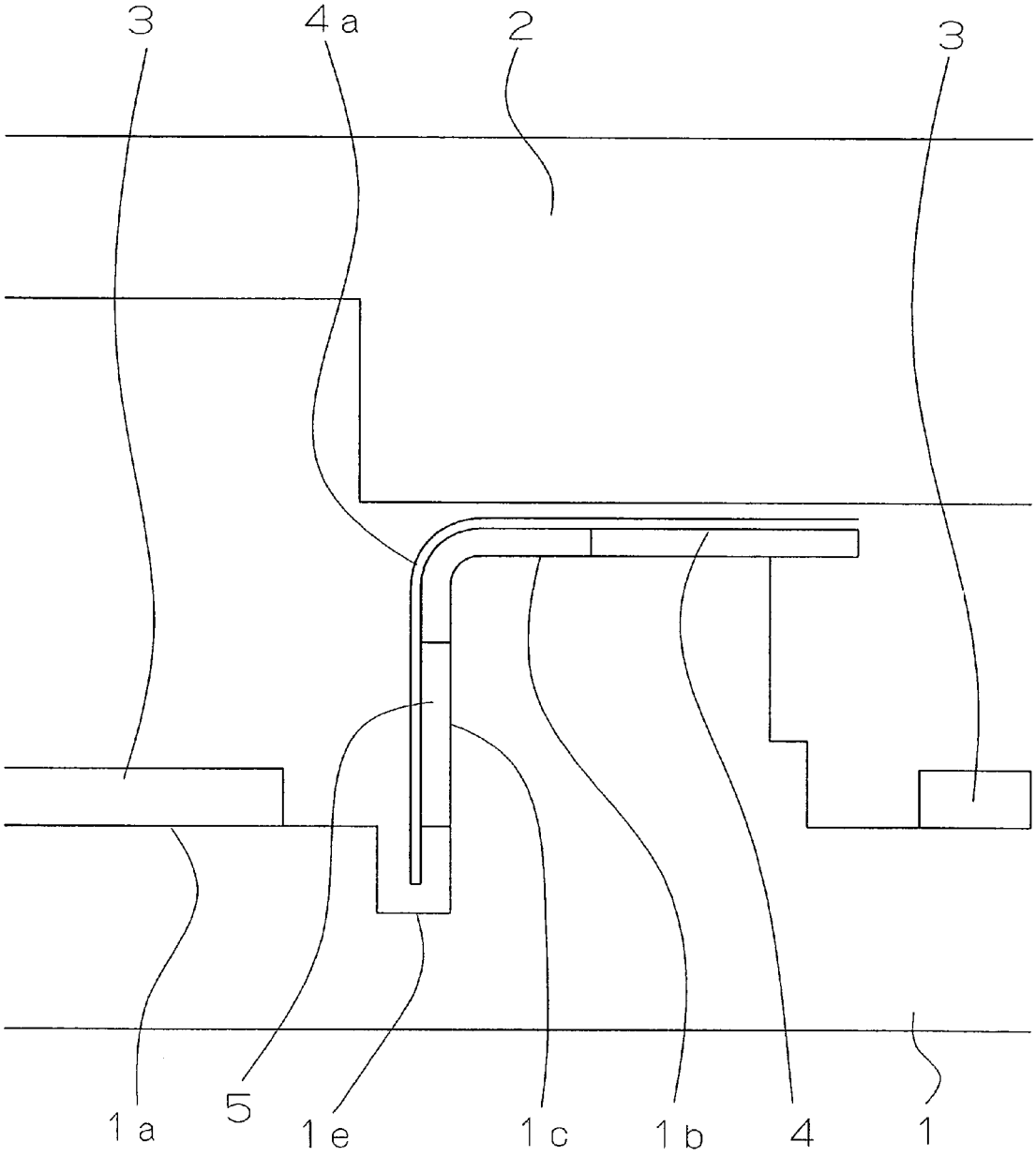
FIG. 5 is an enlarged cross-sectional view of an essential part of the reset current conductive structure adopted by an analogue electronic clock of an embodiment 3 of the present invention.
Figure 6:
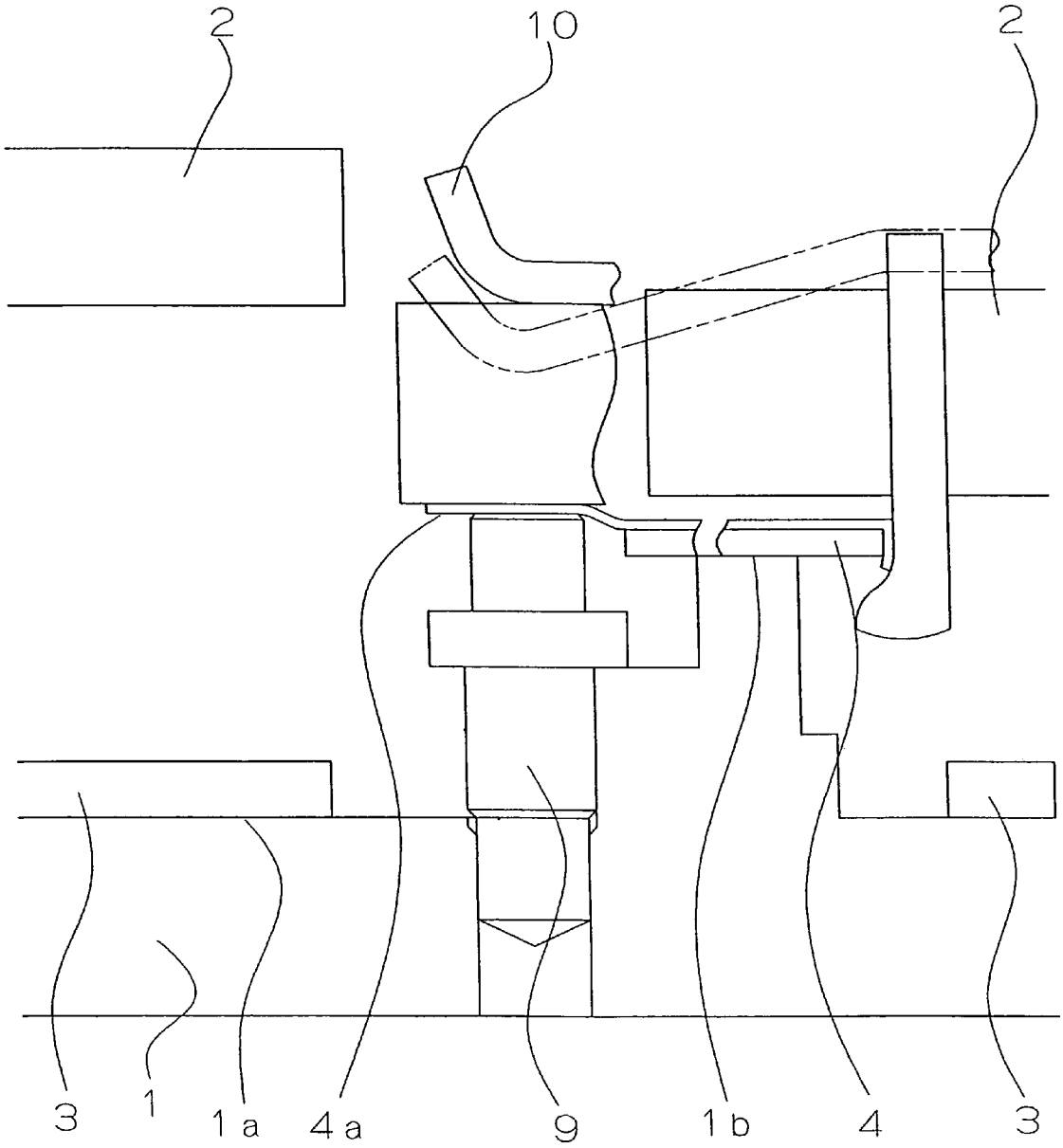
FIG. 6 PRIOR ART
FIG. 6 is an enlarged cross-sectional view of an essential part of the reset current conductive structure adopted by a conventional analogue electronic clock.

An analog electronic clock of the embodiment 3 of the present invention is, as shown in FIG. 1 which is the plan view and FIG. 5 which is a cross-sectional view of an essential part, characterized in that in the analog electronic clock having the reset current conductive structure which is constituted of a winding stem 8, a reset lever 3 having no bent portion on a distal end portion thereof and an overhang pattern 4*a* of a thin printed circuit board 4 made of polyimide or the like, the above-mentioned overhang pattern 4*a* is bent to a height of the reset lever 3, that is, a reset lever planar moving surface 1*a* of a plate 1 and, at the same time, a bent state of the overhang pattern 4*a* is held by a holding means shown in FIG. 5.

That is, the holding means adopted by the embodiment 3 is, as shown in FIG. 5, constituted of an adhesive double coated tape 7 which is adhered to a vertical surface 1*c* of a plate 1 which joins the reset lever planar moving surface 1*a* and a printed circuit board mounting surface 1*b*.

When the movement is assembled, the overhang pattern 4*a* is bent to the height of the reset lever 3, and a distal end portion of the overhang pattern 4*a* reaches a recessed portion 1*e* which is dug downwardly from the reset lever planar moving surface 1*a*. Then, the overhang pattern 4*a* is adhered to the vertical surface 1*c* of the plate 1 due to the adhesive double coated tape 5 and hence, the bent state of the overhang patter is held in this manner. Accordingly, when the winding stem 8 is pulled by one stage, the reset lever 3 performs the planar movement on a surface of the plate 1 in the given direction and the distal end portion 3*a* is brought into contact with the overhang pattern 4*a*. Accordingly, it is possible to form a reset current conductive path which transmits a potential applied to the reset lever 3 when the gear train is stopped to an IC which is mounted on the printed circuit board 4.

In the reset current conductive structure according to the present invention, the conductive part such as the metal pin which is positioned and fixed by the housing such that the conductive part reaches a height of the reset lever becomes unnecessary. Accordingly, due to the present invention, it is possible to reduce the number of parts while maintaining the performance of a movement. Further, a cumbersome operation to control an electrical connection state between a circuit pattern of the printed circuit board and the metal pin becomes unnecessary. Still further, the reset current conductive structure according to the present invention is constituted using the reset lever having no bent portion on the distal end portion. Accordingly, due to the present invention, it is no more necessary to form the bent portion on the reset lever and hence, a size control of the reset lever is facilitated.

What is claimed is:

1. An analog electronic clock comprising:

a reset current conductive structure which is constituted of a winding stem;

a reset lever having no bent portion on a distal end portion thereof; and an overhang-pattern of a printed circuit board;

wherein the overhang-pattern is bent to a height of the reset lever and, at the same time, a bent state of the overhang-pattern is held by a holding means which is mounted in a housing.

2. An analog electronic clock according to claim 1, wherein the holding means is constituted of an embracing recessed portion which is formed on a vertical surface of a plate to which a reset lever planar moving surface of the plate and a mounting surface of the printed circuit board are joined.

3. An analog electronic clock according to claim 1, wherein the holding means is a pressing arm which is integrally formed with a gear train base, and the pressing arm is arranged so as to press the overhang-pattern to the vertical surface of the plate to which the reset lever planar moving surface of the plate and the mounting surface of the printed circuit board are joined.

4. An analog electronic clock according to claim 3, wherein the pressing arm has a pair of arms.

5. An analog electronic clock according to claim 1, wherein the holding means is an adhesive double coated tape which adheres the overhang-pattern to the vertical surface of the plate to which the reset lever planar moving surface of the plate and the mounting surface of the printed circuit board are joined.

6. An analog electronic clock according to claim 1, wherein the printed circuit board is a polyimide-made printed circuit board.

* * * * *